US007716025B2

(12) United States Patent
Bahel et al.

(10) Patent No.: US 7,716,025 B2
(45) Date of Patent: May 11, 2010

(54) CONDENSING UNIT CONFIGURATION SYSTEM

(75) Inventors: Vijay Bahel, Sidney, OH (US); Thomas E. Crone, Tipp City, OH (US); Deborah L. Monnin, Minster, OH (US); Altaf Hossain, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 544 days.

(21) Appl. No.: 10/866,175

(22) Filed: Jun. 11, 2004

(65) Prior Publication Data

US 2005/0004693 A1 Jan. 6, 2005

Related U.S. Application Data

(60) Provisional application No. 60/477,562, filed on Jun. 11, 2003.

(51) Int. Cl.
*G06G 7/48* (2006.01)

(52) U.S. Cl. ..... 703/6; 703/7

(58) Field of Classification Search ..... 703/6–7; 706/45

See application file for complete search history.

(56) References Cited

U.S. PATENT DOCUMENTS 6,002,854 A * 12/1999 Lynch et al. ..... 703/1
6,836,766 B1 * 12/2004 Gilpin et al. ..... 706/1
7,003,477 B2 * 2/2006 Zarrow ..... 705/11

FOREIGN PATENT DOCUMENTS

JP H9-257319 10/1997

OTHER PUBLICATIONS

Porkhial et al.; Transient characteristic of reciprocating compressors in household refrigerators; Applied Thermal Engineering 22 (2002) 1391-1402.*

Vanwelkenhuysen; The tender support system; Knowledge-Based Systems 11 (1998) 363-372.*

* cited by examiner

*Primary Examiner*—Hugh Jones
(74) *Attorney, Agent, or Firm*—Harness, Dickey & Pierce, P.L.C.

(57) ABSTRACT

A system and method for configuring a condensing unit for a cooling system includes inputting one of a cooling system characteristic, a condensing unit characteristic and a compressor characteristic for the cooling system, applying embedded design rules and accessing a condensing unit database of component attributes and their relationships. A base condensing unit is determined based on the one of a cooling system characteristic, a condensing unit characteristic and a compressor characteristic for the cooling system. The method further includes selecting various accessories of the condensing unit for customizing the base condensing unit based on the particular application.

31 Claims, 26 Drawing Sheets

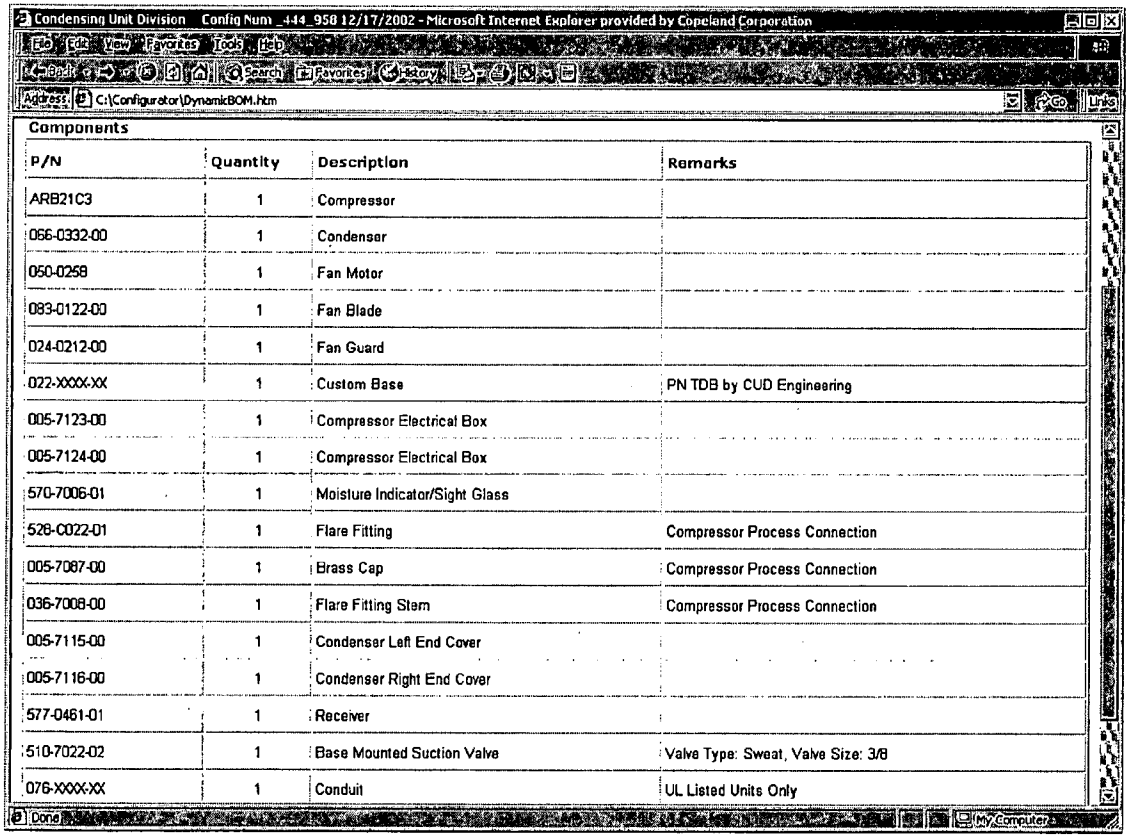

| P/N | Quantity | Description | Remarks |
|---|---|---|---|
| ARB21C3 | 1 | Compressor | |
| 066-0332-00 | 1 | Condenser | |
| 050-0258 | 1 | Fan Motor | |
| 083-0122-00 | 1 | Fan Blade | |
| 024-0212-00 | 1 | Fan Guard | |
| 022-XXXX-XX | 1 | Custom Base | PN TDB by CUD Engineering |
| 005-7123-00 | 1 | Compressor Electrical Box | |
| 005-7124-00 | 1 | Compressor Electrical Box | |
| 570-7006-01 | 1 | Moisture Indicator/Sight Glass | |
| 528-0022-01 | 1 | Flare Fitting | Compressor Process Connection |
| 005-7067-00 | 1 | Brass Cap | Compressor Process Connection |
| 036-7008-00 | 1 | Flare Fitting Stem | Compressor Process Connection |
| 005-7115-00 | 1 | Condenser Left End Cover | |
| 005-7116-00 | 1 | Condenser Right End Cover | |
| 577-0461-01 | 1 | Receiver | |
| 510-7022-02 | 1 | Base Mounted Suction Valve | Valve Type: Sweat, Valve Size: 3/8 |
| 076-XXXX-XX | 1 | Conduit | UL Listed Units Only |

*Figure 24*

| | | | | | | | | |
|---|---|---|---|---|---|---|---|---|
| 3 | | Copeland Corporation | | | | | | |
| 4 | | Condensing Unit Division | | | | | | |
| 5 | | 60Hz Air-Cooled Unit Performance | | | | | | |
| 6 | | | | 11/17/00 | | | | |
| 7 | | | | | | | | |
| 8 | Unit Model: | MMPH-0022 | | | | Refrigerant: | | R-22 |
| 9 | Compressor: | ARB21C3 | | | | Return Gas Temp. (°F): | | 65 |
| 10 | Condenser: | 066-0332-00 x 1 | | | | Subcooling (°F): | | 5 |
| 11 | Fan Blade: | 083-0122-00 x 1 | | | | Air Flow Rate (CFM): | | 235 |
| 12 | Fan Motor: | 050-0258 x 1 | | | | Fan Motor Power (Watt): | | 33 |
| 13 | | | | | | | | |
| 14 | | Performance : 90°F Ambient Air Temperature | | | | | | |
| 15 | Evap. Temp. | Unit Capacity | Power | Unit EER | Cond. Temp. | Temp. Diff. | Refr. Pd. | Air Pd. |
| 16 | (°F) | (Btu/hr) | (Watt) | (Btu/Wh) | (°F) | (°F) | (Psi) | (Inch Wg) |
| 17 | 0 | 980 | 270 | 3.6 | 103.8 | 13.8 | 0.1 | 0.12 |
| 18 | 5 | 1,100 | 280 | 3.9 | 105.4 | 15.4 | 0.1 | 0.12 |
| 19 | 10 | 1,250 | 300 | 4.2 | 107.3 | 17.3 | 0.1 | 0.12 |
| 20 | 15 | 1,380 | 310 | 4.5 | 109.1 | 19.1 | 0.1 | 0.12 |
| 21 | 20 | 1,530 | 330 | 4.6 | 111.0 | 21.0 | 0.1 | 0.12 |
| 22 | 25 | 1,680 | 340 | 4.9 | 113.1 | 23.1 | 0.1 | 0.12 |
| 23 | 30 | 1,840 | 360 | 5.1 | 115.5 | 25.5 | 0.1 | 0.12 |
| 24 | 35 | 2,010 | 380 | 5.3 | 118.0 | 28.0 | 0.1 | 0.12 |
| 25 | 40 | 2,180 | 400 | 5.5 | 120.8 | 30.8 | 0.1 | 0.12 |
| 26 | 45 | 2,360 | 410 | 5.8 | 123.8 | 33.8 | 0.1 | 0.12 |
| 27 | | | | | | | | |
| 28 | | Performance : 100°F Ambient Air Temperature | | | | | | |
| 29 | Evap. Temp. | Unit Capacity | Power | Unit EER | Cond. Temp. | Temp. Diff. | Refr. Pd. | Air Pd. |
| 30 | (°F) | (Btu/hr) | (Watt) | (Btu/Wh) | (°F) | (°F) | (Psi) | (Inch Wg) |
| 31 | 0 | 880 | 270 | 3.3 | 113.5 | 13.5 | 0.1 | 0.12 |
| 32 | 5 | 990 | 290 | 3.4 | 115.0 | 15.0 | 0.1 | 0.12 |
| 33 | 10 | 1,140 | 310 | 3.7 | 116.6 | 16.6 | 0.1 | 0.12 |
| 34 | 15 | 1,270 | 320 | 4.0 | 118.3 | 18.3 | 0.1 | 0.12 |
| 35 | 20 | 1,400 | 340 | 4.1 | 120.1 | 20.1 | 0.1 | 0.12 |
| 36 | 25 | 1,550 | 360 | 4.3 | 122.1 | 22.1 | 0.1 | 0.12 |
| 37 | 30 | 1,700 | 370 | 4.6 | 124.1 | 24.1 | 0.1 | 0.12 |

*Figure 26*

CONDENSING UNIT CONFIGURATION SYSTEM

CROSS-REFERENCE TO RELATED APPLICATIONS

This application claims the benefit of U.S. Provisional Application No. 60/477,562, filed on Jun. 11, 2003.

FIELD OF THE INVENTION

The present invention relates to condensers, and more particularly to configuring a condensing unit for an air-conditioning or refrigeration system.

BACKGROUND OF THE INVENTION

Traditional cooling systems, such as refrigeration and air-conditioning systems, include a compressor, a condensing unit, an expansion valve and an evaporator. The compressor compresses gaseous refrigerant exiting the evaporator and discharges the high pressure refrigerant to the condensing unit. The condensing unit operates as a heat exchanger enabling heat transfer from the gaseous refrigerant to a heat sink (e.g. air or water). The refrigerant condenses within the condensing unit and a state change occurs from gas to liquid. The liquid refrigerant exits the condensing unit and flows to the evaporator through the expansion valve. The evaporator also operates as a heat exchanger enabling heat transfer from the atmosphere surrounding the evaporator to the liquid refrigerant. As the heat transfer occurs, the temperature of the refrigerant increases until a state change occurs from liquid to gas. The gas refrigerant is drawn into the suction side of the compressor and the cooling cycle continues.

The condensing unit can be one of an air-cooled condensing unit (ACU) or a water-cooled condensing unit (WCU). An ACU typically includes a fin-tube refrigerant-to-air heat exchanger, an air flow device such as a fan motor and fan blade and associated controls (not shown). In the case of an ACU, air provides the heat sink enabling heat transfer from the condensing unit. A WCU typically includes a refrigerant-to-water heat exchanger and associated controls (not shown). In the case of a WCU, water provides the heat sink enabling heat transfer from the condensing unit.

The particular configuration of the condensing unit depends on various system parameters including the compressor, heat exchanger, controls, refrigerant type, operating temperatures and the like. As a result, repetitive design and testing steps are typically required to provide an appropriate condensing unit for a given cooling system.

SUMMARY OF THE INVENTION

The present invention provides a system and method for knowledge-based configuration of a condensing unit for a cooling system. The method includes inputting one of a cooling system characteristic, a condensing unit characteristic, a compressor characteristic for the cooling system and accessing design rules and a database of valid component relationships and their attributes. A base condensing unit is determined based on the one of a cooling system characteristic, a condensing unit characteristic and a compressor characteristic for the cooling system. The method further includes selecting desired accessories for customizing the base condensing unit.

In one feature, the cooling system characteristic includes a cooling system capacity.

In another feature, the cooling system characteristic includes a cooling system horsepower.

In another feature, the cooling system characteristic includes design criteria. The design criteria includes at least one of a group consisting of refrigerant type, temperature range, evaporator temperature, normal air temperature, maximum air temperature, frequency, phase and voltage.

In another feature, the condensing unit characteristic includes a condensing unit model number.

In another feature, the compressor characteristic is a compressor model number.

In still another feature, the method further comprises determining the price of the configured condensing unit and outputting a quote (spec) sheet summarizing key characteristics and bill-of-materials of the condensing unit cost.

In another feature, the accessories include at least one of a group consisting of an accumulator, a filter drier, a moisture indicator, a shrader fitting, a discharge line thermostat, a crankcase heater, a monel discharge tube, a conduit, a service cord, a base mounted electrical box, condenser end covers, a fan guard and a defrost timer.

In another feature, the method further comprises determining high and low side options such as low ambient controls, pressure vessel (receiver) and shut-off valves.

In yet another feature, the method further comprises determining various pressure control options for the base condensing unit.

Another feature provides embedded rules to verify if the configuration meets Underwriter Laboratories safety regulations.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 24 is a screen-shot illustrating an exemplary BOM list;

FIG. 26 is a screen-shot illustrating exemplary thermal performance data.

DETAILED DESCRIPTION OF THE PREFERRED EMBODIMENTS

The following description of the preferred embodiments is merely exemplary in nature and is in no way intended to limit the invention, its application, or uses.

Figure 1:
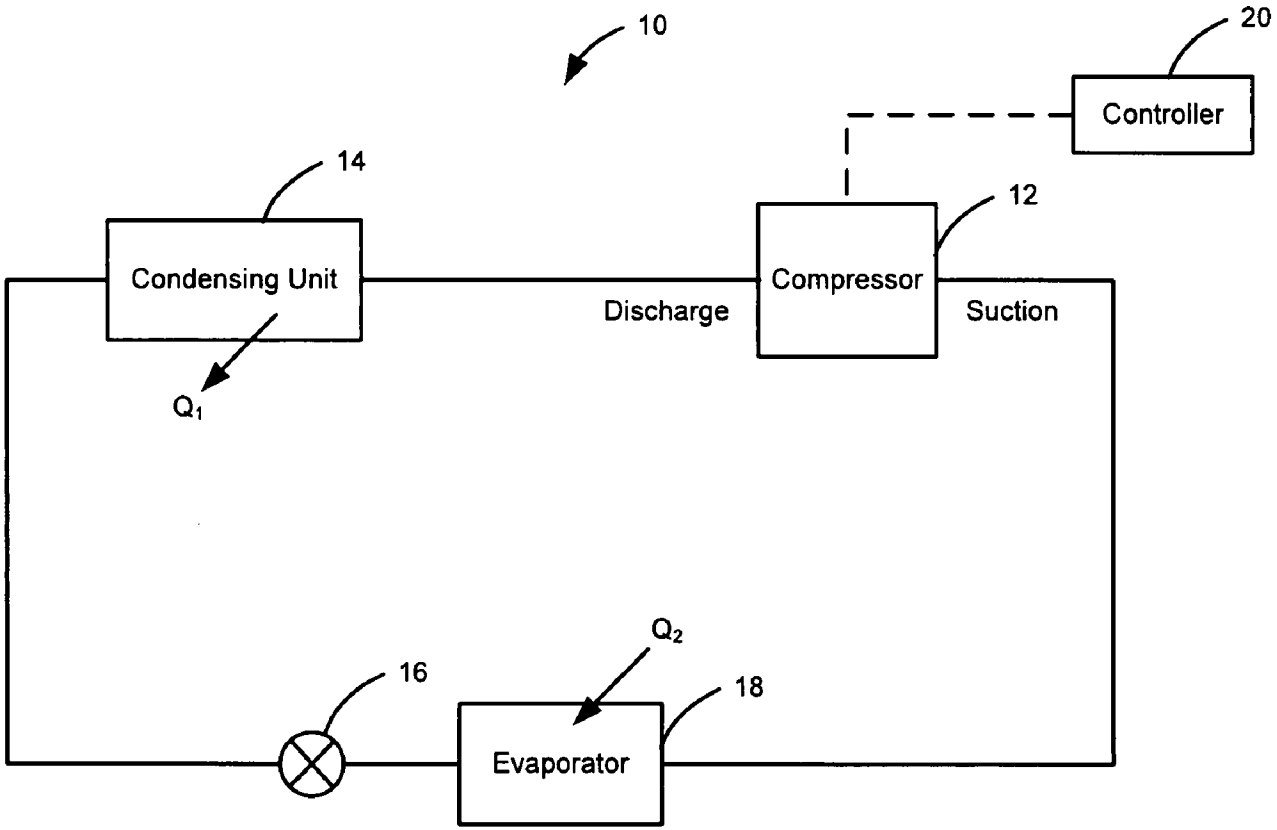
Figure 1 Prior Art
FIG. 1 is a schematic illustration of a cooling system incorporating a condensing unit.

Referring now to FIG. 1, a generic cooling system 10 includes a compressor 12, a condensing unit 14, an expansion valve 16 and an evaporator 18. The compressor 12 is controlled by a controller 20 and compresses gaseous refrigerant exiting the evaporator 18. The compressor 12 discharges the high pressure refrigerant to the condensing unit 14. The condensing unit 14 operates as a heat exchanger enabling heat transfer ($Q_1$) from the gaseous refrigerant to a heat sink (e.g., air or water). The refrigerant condenses within the condensing unit 14 and a state change occurs from gas to liquid. The liquid refrigerant exits the condensing unit 14 and flows to the evaporator 18 through the expansion valve 16. The evaporator 18 also operates as a heat exchanger enabling heat transfer ($Q_2$) from the atmosphere surrounding the evaporator 18 to the liquid refrigerant. As the heat transfer occurs, the temperature of the refrigerant increases until a state change occurs from liquid to gas. The gas refrigerant is drawn into the suction side of the compressor 12 and the cooling cycle continues.

The condensing unit configurator is provided as a software package that enables easy entry of pertinent data, as well as automatic access to engineering design rules and various databases containing pertinent component attributes and their relationship information. As a software package, the condensing unit configurator quickly and seamlessly determines the configuration of the condensing unit 14 and provides comprehensive performance information. More specifically, the condensing unit configurator provides a rule-based algorithm that automates the engineering design and associated processes used to streamline the design process.

The configurator incorporates engineering design standards, Underwriter Laboratories (UL) safety regulations and pricing information to provide a quick response to customer needs. A user inputs system requirements including thermal performance, application type and optional components. The condensing unit configurator generates information including standard, off-the-shelf products, custom design solutions, engineering drawings, thermal performance information, bill of material (BOM) identifying key components and pricing information.

The elements of the condensing unit configurator include component databases, engineering rules, design processes and pricing algorithms. Other elements include physical and electrical component relationships and thermodynamic algorithms. The configurator uses two component categories to configure valid condensing unit assemblies. A major components category is used to build the thermal capacity module of the condensing unit. The components in the major components category include compressors, heat exchangers, air flow devices (e.g., fan motor and fan blade) and mounting chassis. An optional components category does not effect thermal performance, but is used for other functions of the condensing unit. The components in the optional components category include controls, pressure vessels, valves, fittings, electrical boxes and the like.

Figure 2:
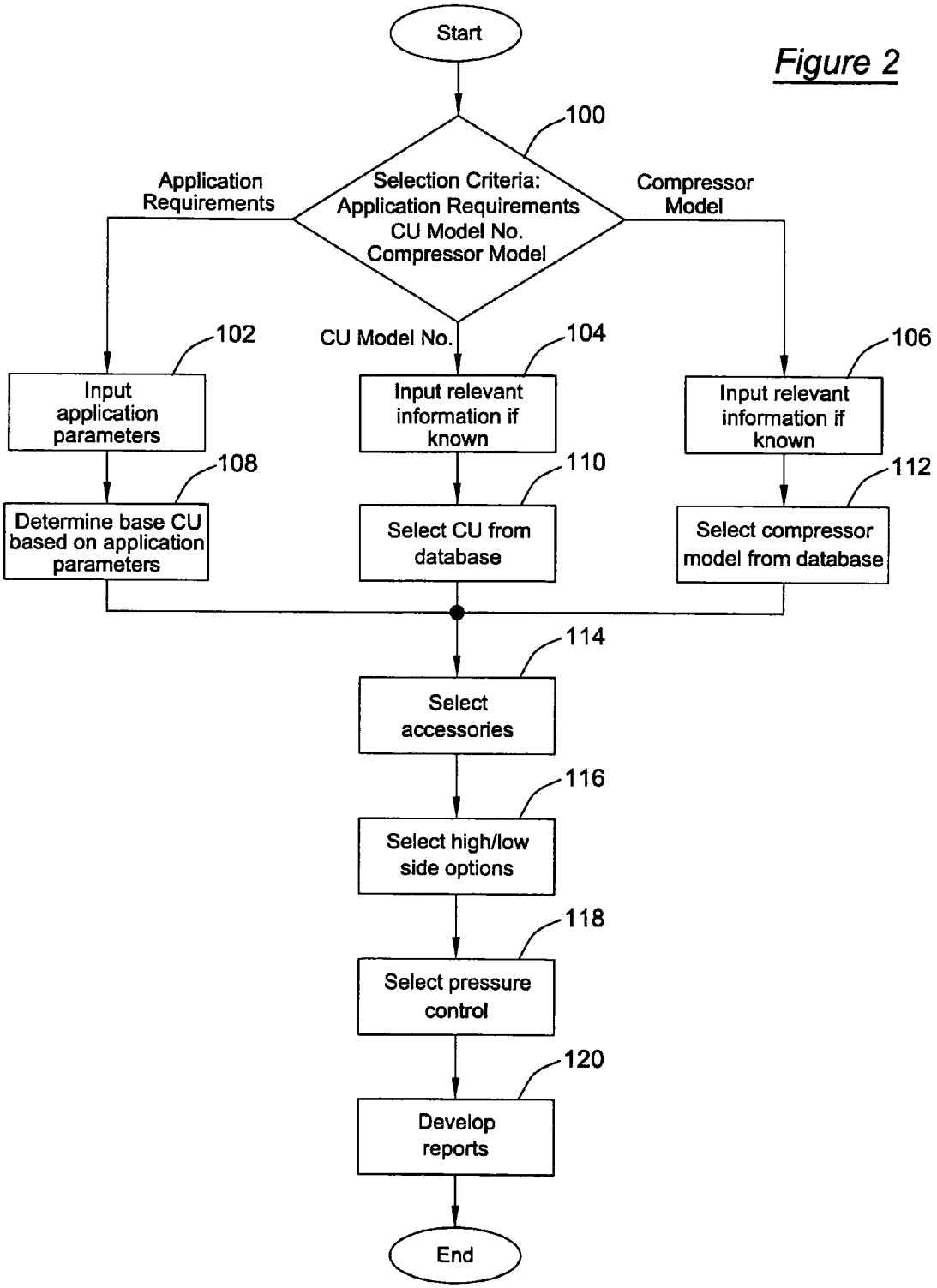
FIG. 2 is a flowchart detailing a condensing unit configurator according to the present invention.
Figure 3:
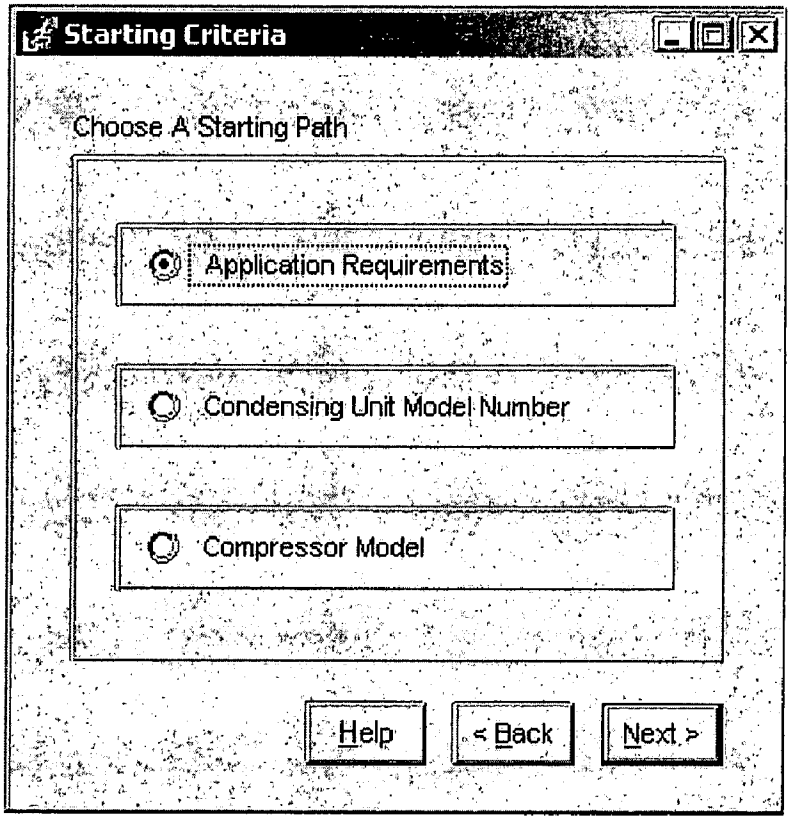
FIG. 3 is a screen-shot illustrating starting path selection options of the configurator.

Referring now to FIG. 2, a flowchart provides a general outline of the condensing unit configurator according to the present invention. FIGS. 3 through 15 provide software screen-shots illustrating particular steps of the configurator. The condensing unit configurator provides a user with three starting paths to initiate the configuration process: application requirements, condensing unit model number and compressor model.

Using the application requirements path, the user enters the capacity (Btu/hour or horsepower), electrical parameters (e.g., volts, frequency, phase), refrigerant type and application type (e.g., high, medium and low temperature installation). Using the condensing unit model number path, the user inputs a known, standard off-the-shelf unit. The configurator assists the user in modifying the standard unit by selecting optional components (i.e., custom design). Using the compressor model path, the user inputs a specific compressor model, its electrical parameters, refrigerant type and application type.

The configurator lists condensing units that feature the selected compressor model. In step 100, the user selects between the application requirements path, the condensing unit model number path or the compressor model path (see FIG. 3). If the user selects the application requirements path the configurator continues in step 102. If the user selects the condensing unit model number path, the configurator continues in step 104 and if the user selects the compressor model path, the configurator continues in step 106.

Figure 4:
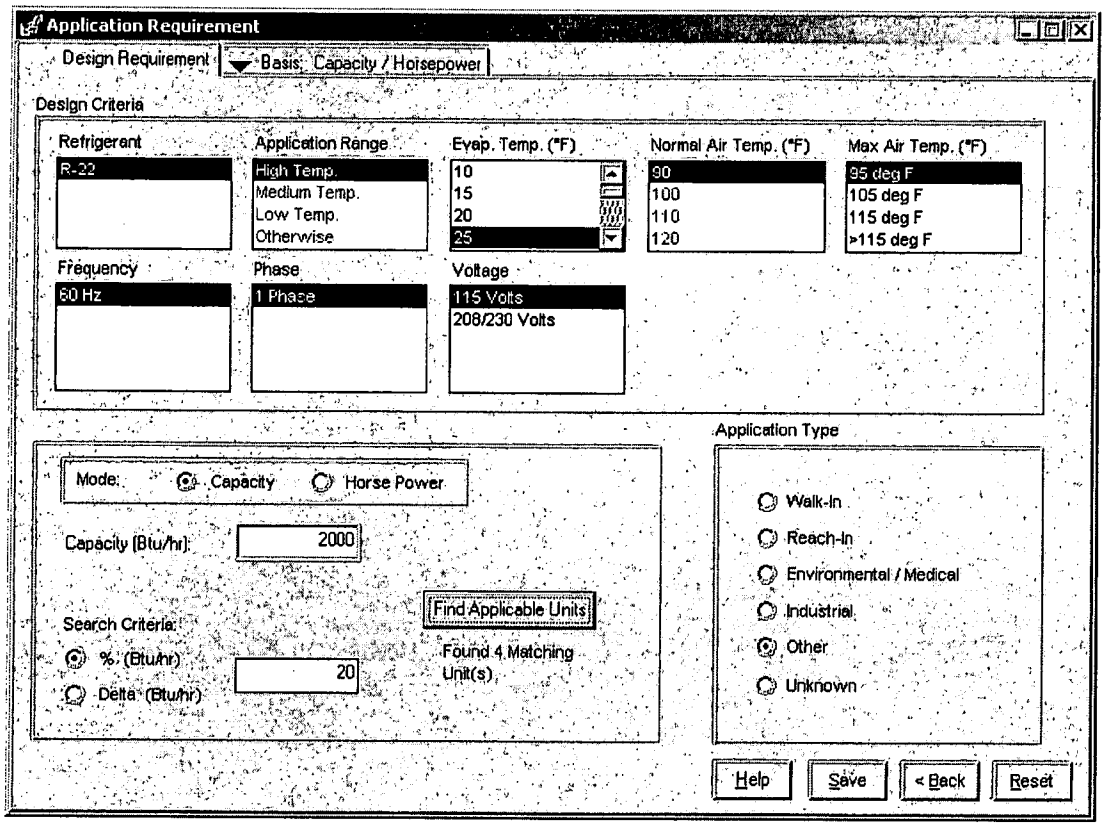
FIG. 4 is a screen-shot illustrating a design requirements screen using an applications requirement starting path based on capacity.
Figure 5:
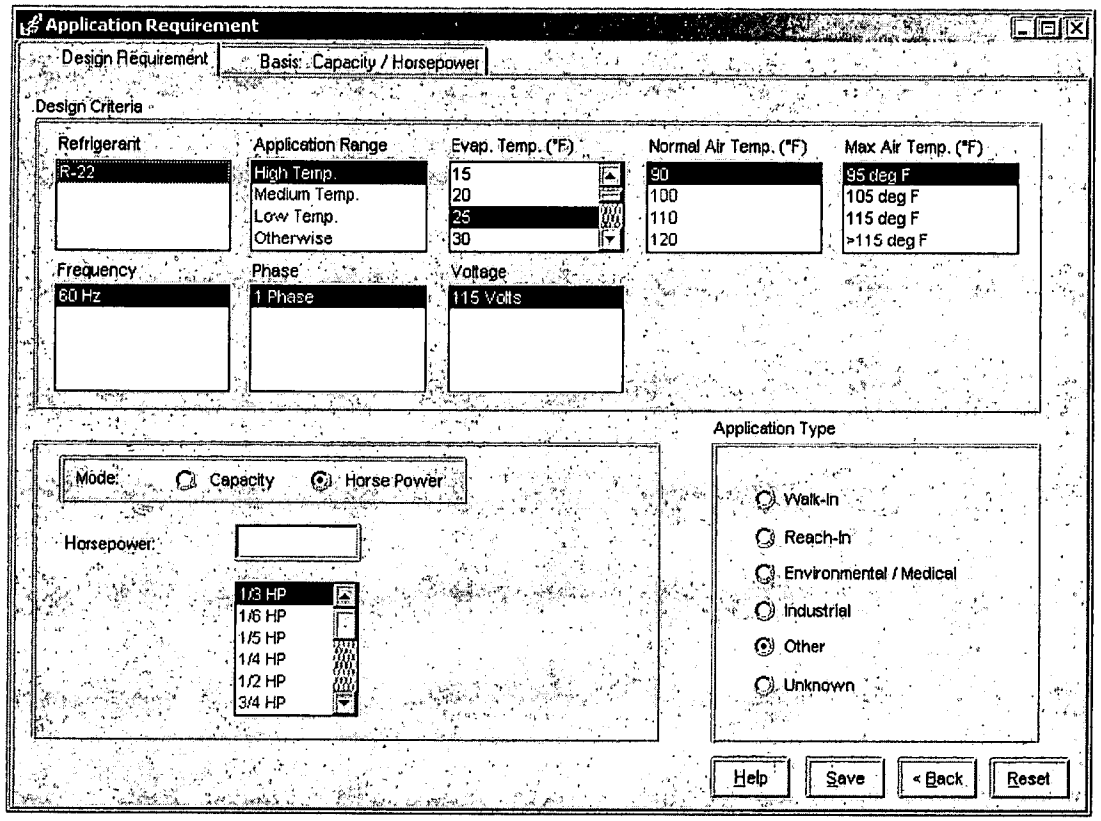
FIG. 5 is a screen-shot illustrating a design requirements screen using the applications requirement starting path based on horsepower.

In step 102, the user inputs the application parameters. The application parameters include design criteria, mode and application type. More specifically, the design criteria include refrigerant type, application range, evaporator temperature, normal ambient temperature, maximum ambient temperature and electrical information (e.g., frequency, phase and voltage). The application types indicate the particular type of fixture (e.g., walk-in, reach-in, environmental/medical, industrial, other or unknown). The key application parameter is the mode, which includes either capacity or horsepower. FIG. 4 illustrates an application parameter input screen for the capacity mode and FIG. 5 illustrates an application parameter input screen for the horsepower mode.

Figure 6:
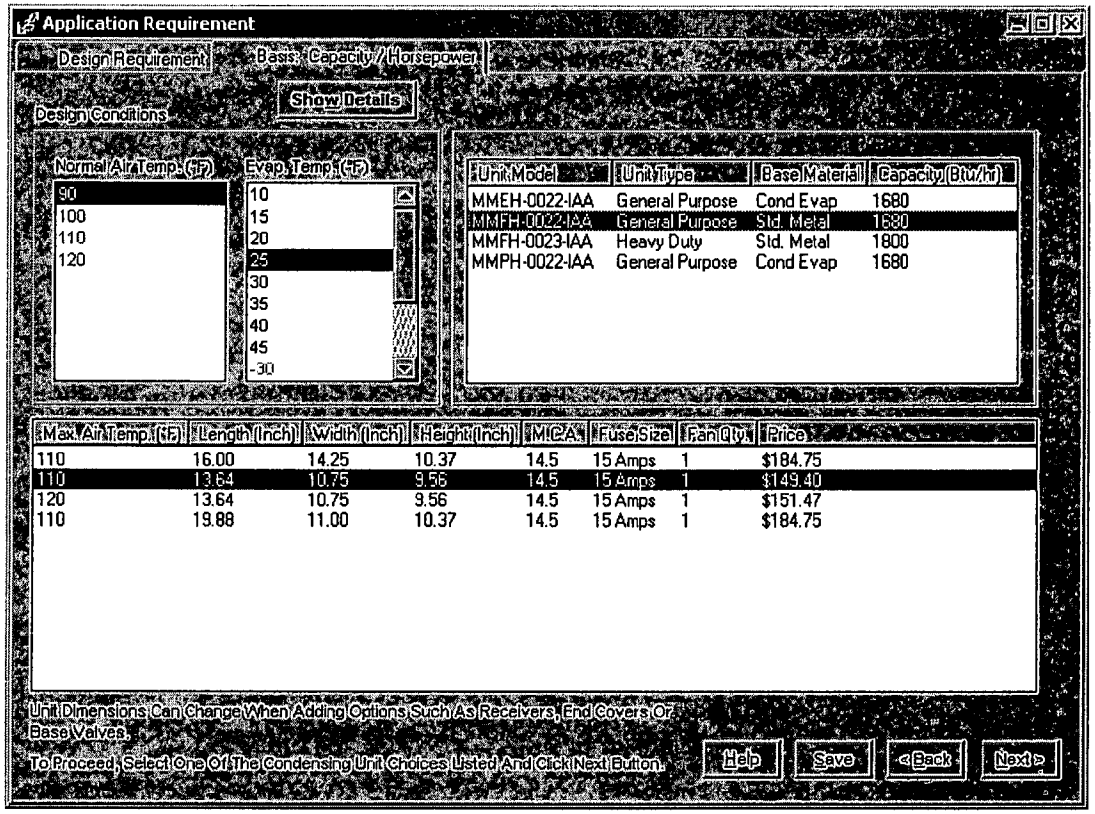
FIG. 6 is a screen-shot illustrating a base condensing unit screen using the applications requirement starting path.

In step 108, the configurator determines condensing units based on the application parameters and provides an output screen based on the particular mode (see FIG. 6). The output screen shows the basic condensing unit configurations (i.e., without optional components) and provides associated information such as physical dimensions, thermal performance, electrical information and pricing information.

Figure 7:
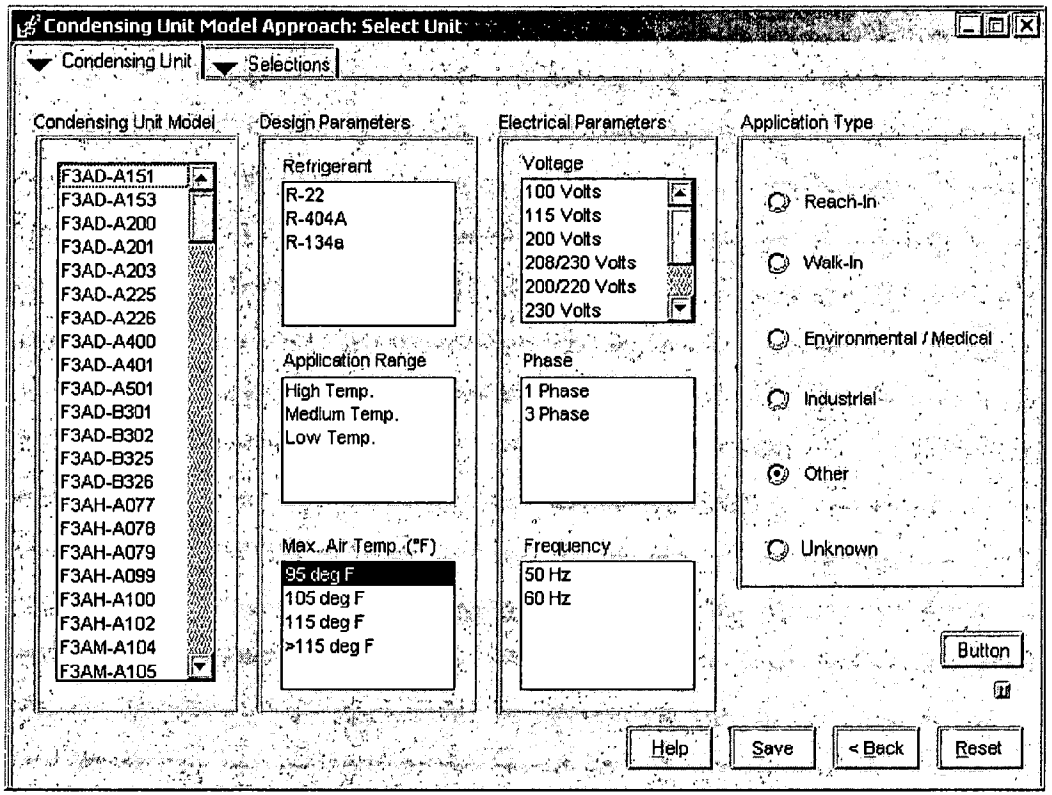
FIG. 7 is a screen-shot illustrating a configuration choices screen using a condensing unit model number starting path.

In step 104, the user inputs known, relevant condensing unit information (see FIG. 7). This information includes condensing unit model number, design parameters, electrical parameters and application type. More specifically, the design parameters include refrigerant type, application range and maximum ambient temperature. The electrical parameters include frequency, phase and voltage. The application types indicate the particular type of fixture (e.g., walk-in, reach-in, environmental/medical, industrial, other or unknown).

Figure 8:
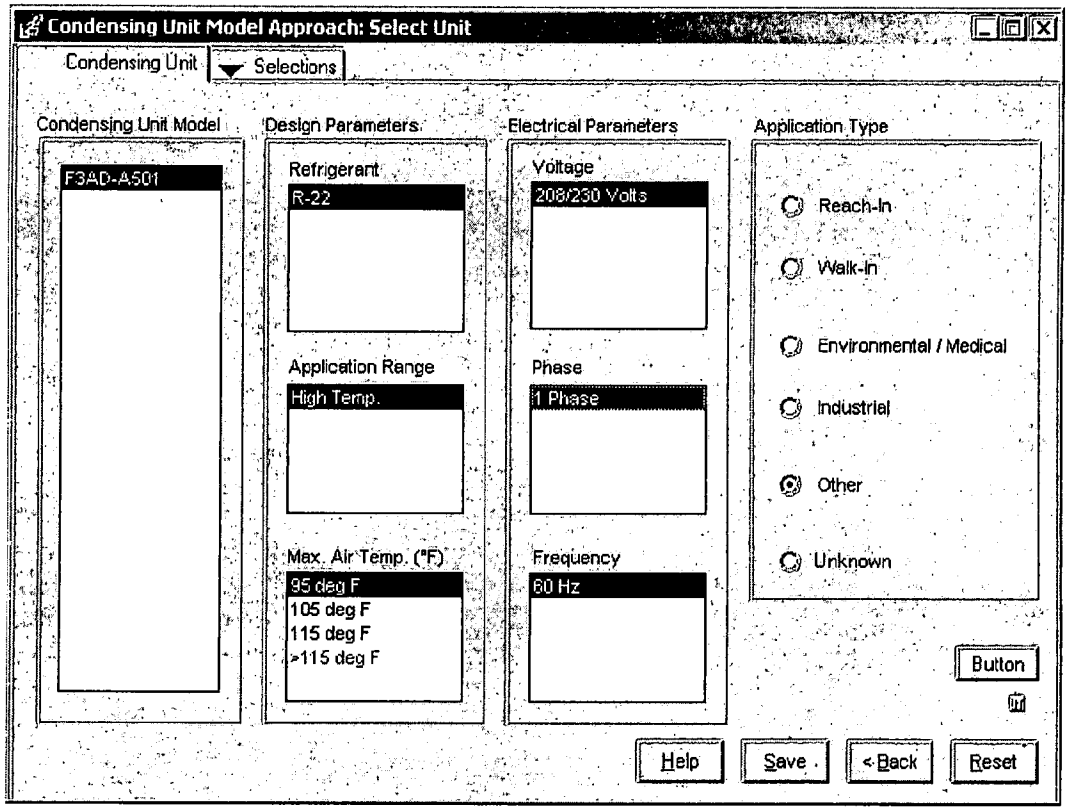
FIG. 8 is a screen-shot illustrating base condensing unit configuration choices using the condensing unit model number stating path.
Figure 9:
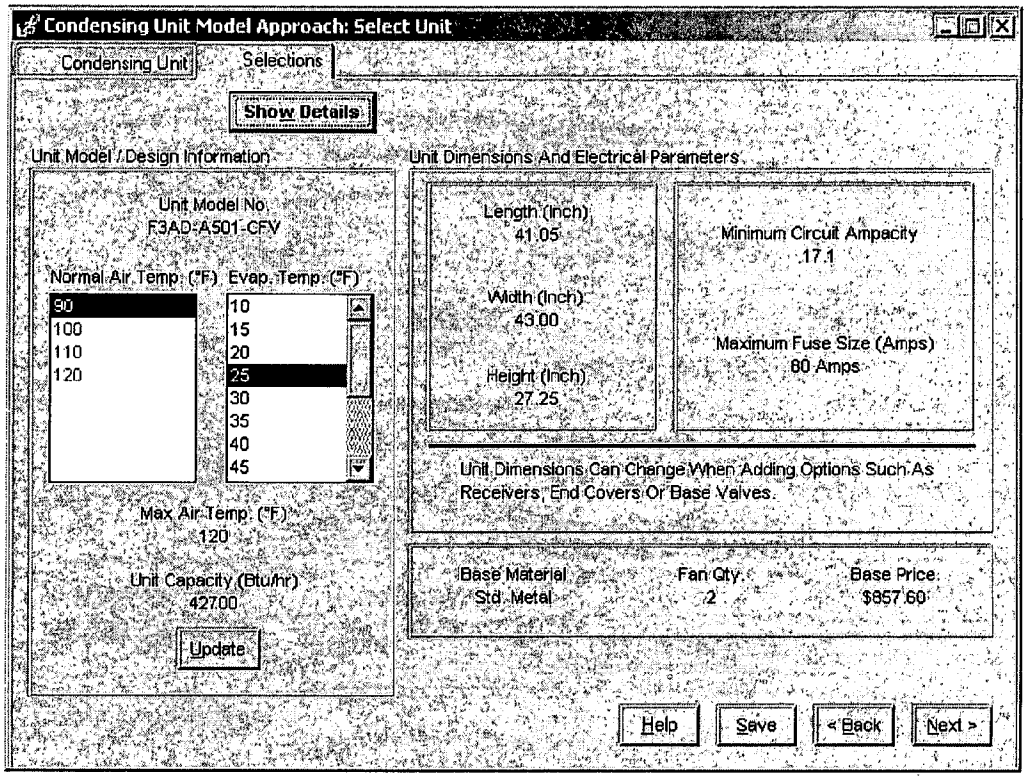
FIG. 9 is a screen-shot illustrating key information of a selected condensing unit using the condensing unit model number starting path.

The user can immediately select a condensing unit model number. However, if the user is unsure of the exact model number, the condensing unit model number list narrows based on the condensing unit information input. In other words, the condensing unit model number list gradually becomes shorter as information such as refrigerant type, application range, voltage, application type and the like are input. In step 110, the user selects the exact condensing unit desired. As shown in FIG. 8, the configurator summarizes the specific condensing unit information for the chosen condensing unit. The configurator also summarizes relevant condensing unit information as seen in FIG. 9. This information includes, design information such as normal air temperature, evaporator temperature, maximum air temperature, unit capacity, dimensions and electrical parameters. The base price (without optional components) of the condensing unit is also provided.

Figure 10:
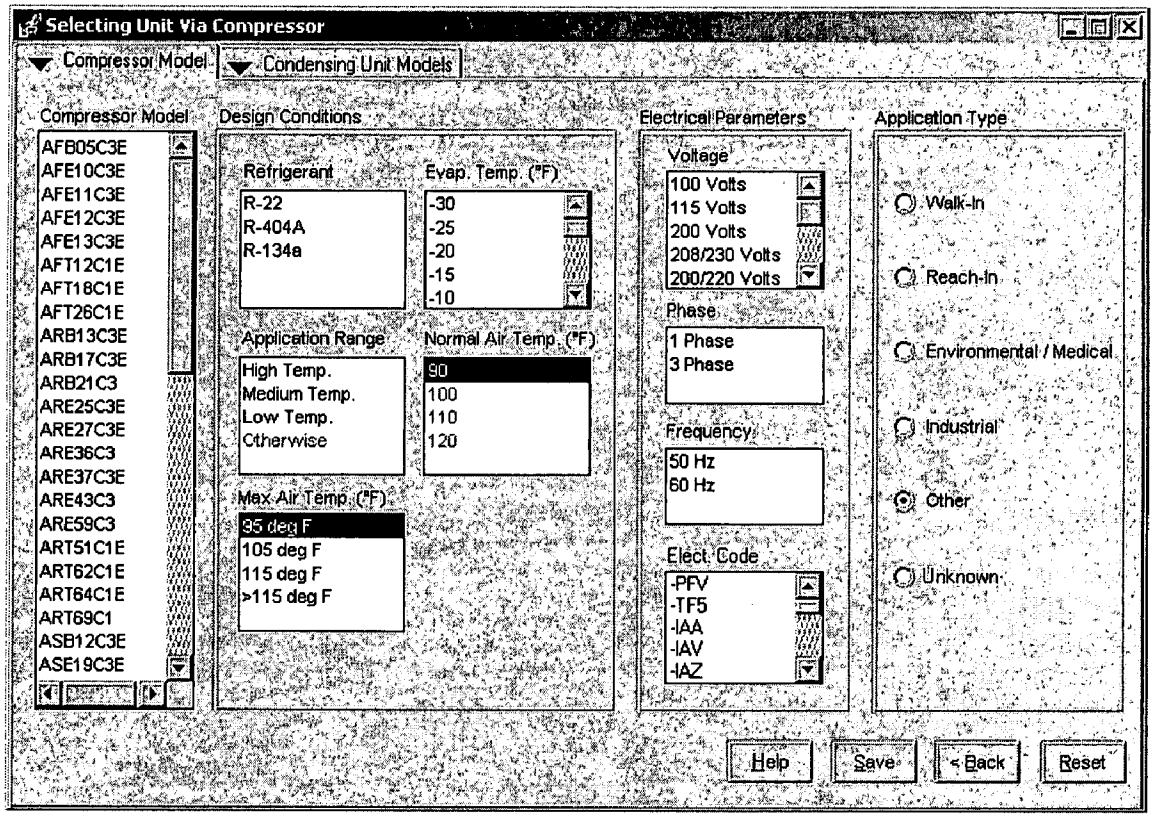
FIG. 10 is a screen-shot illustrating condensing unit selection using a compressor model starting path.

In step 106, the user inputs known, relevant compressor information (see FIG. 10). This information includes compressor model number, design conditions, electrical parameters and application type. More specifically, the design conditions include refrigerant type, application range, maximum air temperature, evaporator temperature and normal air temperature. The electrical parameters include frequency, phase, voltage and electrical code. The application types indicate the particular type of fixture (e.g., walk-in, reach-in, environmental/medical, industrial, other or unknown).

Figure 11:
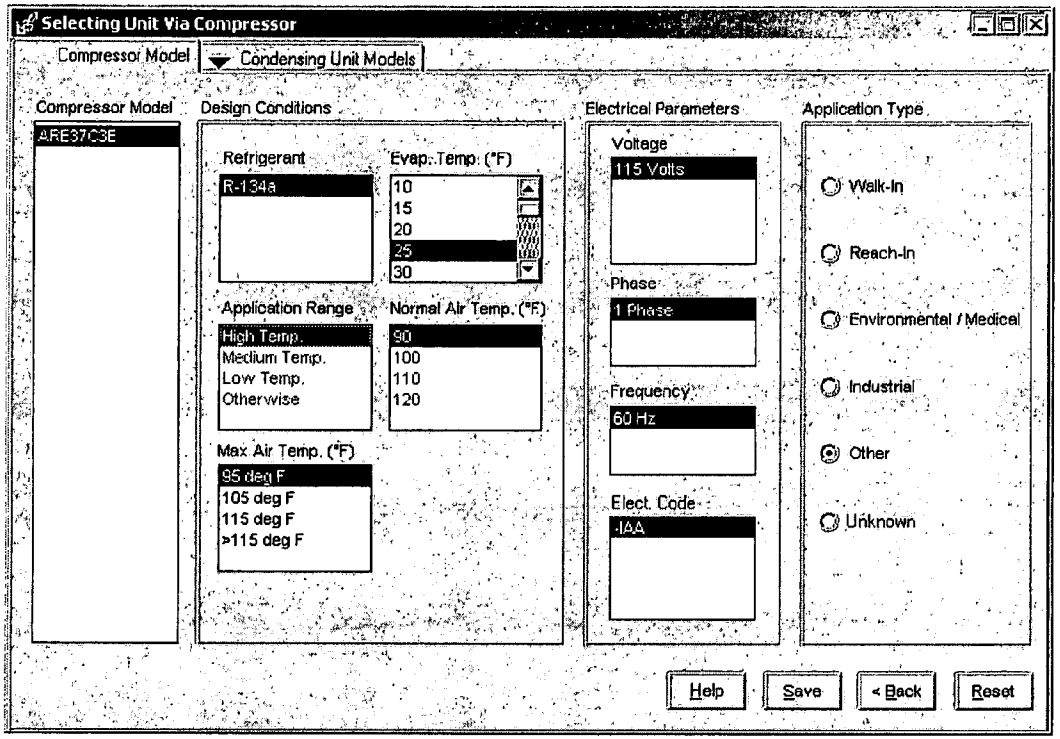
FIG. 11 is a screen-shot illustrating compressor selection using the compressor model starting path.
Figure 12:
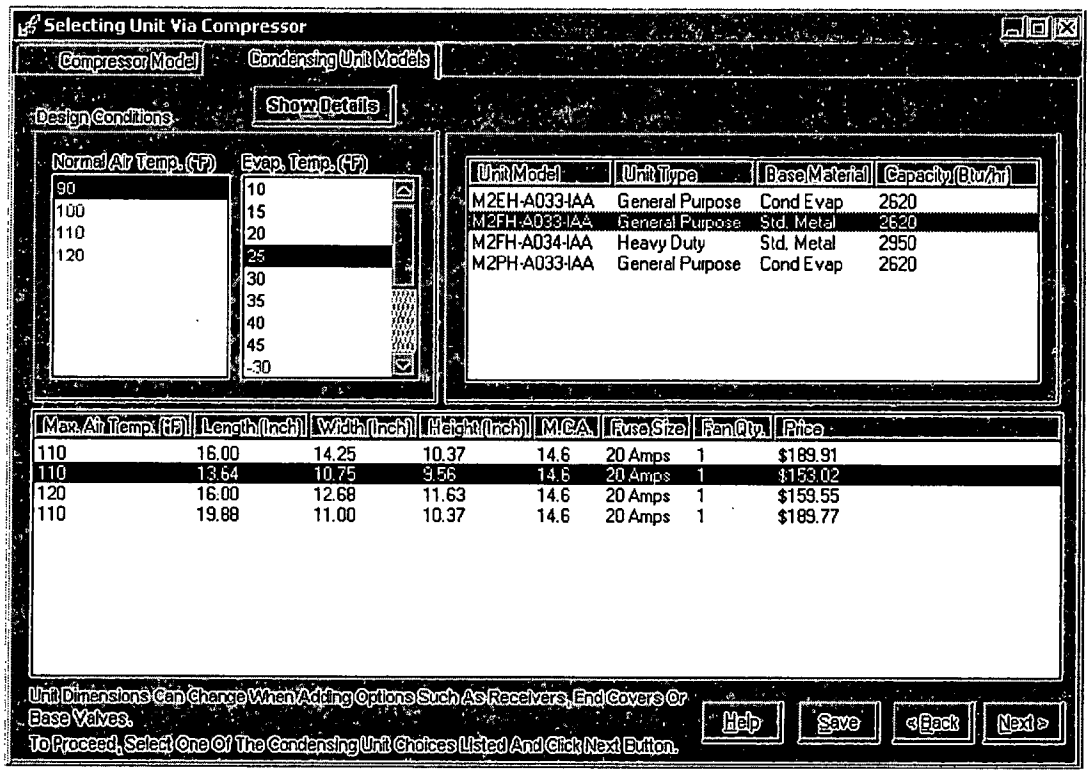
FIG. 12 is a screen-shot illustrating condensing unit configuration choices using the compressor model starting path.
Figure 13:
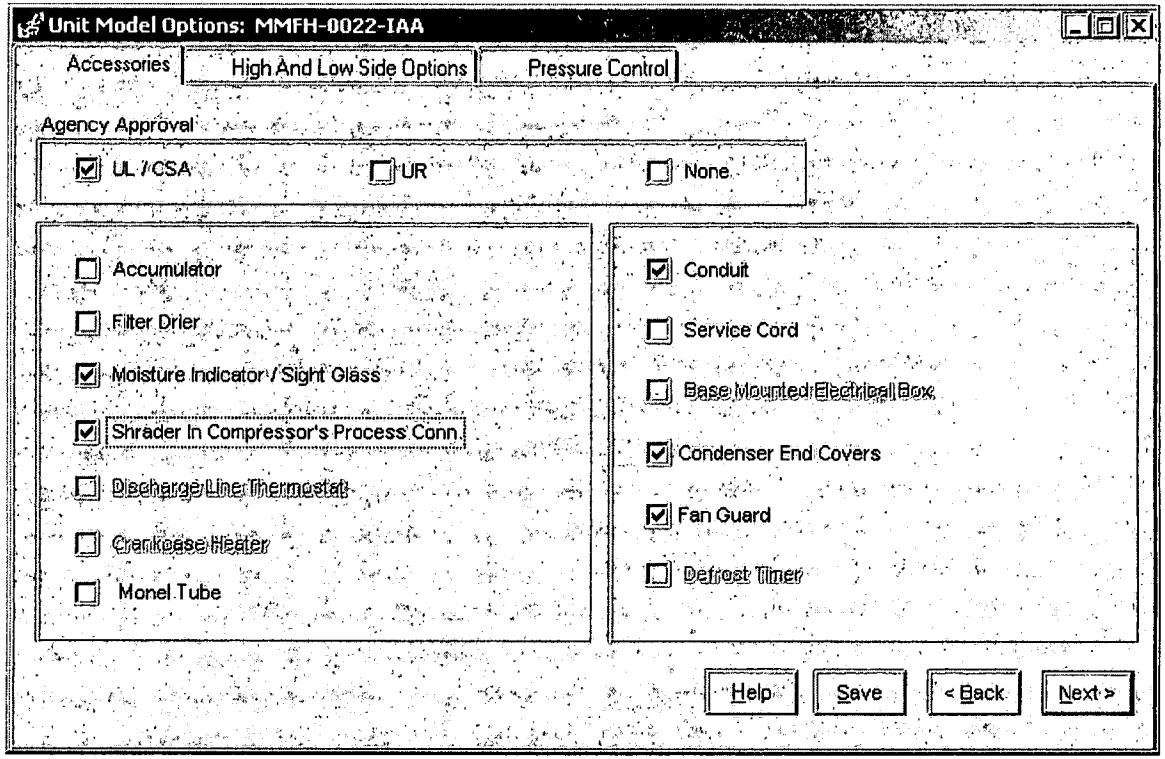
FIG. 13 is a screen-shot illustrating accessory options of the configurator.

The user can immediately select a compressor model number. However, if the user is unsure of the exact model number, the compressor model number list narrows based on the compressor information input. In other words, the compressor model number list gradually becomes shorter as information such as refrigerant type, application range, voltage, application type and the like are input. In step 112, the user selects the exact compressor desired. As shown in FIG. 11, the configurator summarizes the information for the chosen compressor. As seen in FIG. 12, the configurator lists the specific condensing units available for use with the user specified compressor. The information for the possible condensing units is summarized. This information includes, design information such as normal air temperature, evaporator temperature, maximum air temperature, unit capacity, dimensions and electrical parameters. The base price (without optional components) of the condensing unit is also provided.

Regardless of the path used to determine the base condensing unit (i.e., major components category), the configurator continues in steps 114, 116 and 118 to determine the desired options (i.e., optional components category) for air-cooled condensing units. In step 114, the user selects desired accessories from an accessory menu (see FIG. 13). The accessories include an accumulator, a filter drier, a moisture indicator/sight glass, a shrader in the compressor's process connector, a discharge line thermostat, a crankcase heater, a monel discharge tube, a conduit, a service cord, a base mounted electrical box, condenser end covers, a fan guard and a defrost timer. The user selects a check box next to the desired accessory. Only valid accessory choices are displayed. Those accessories that are unavailable for the particular model type are grayed and not selectable by the user. The configurator also checks and indicates agency approval for the particular condensing unit and optional components selected, including UL/CSA, UR or none.

Figure 14:
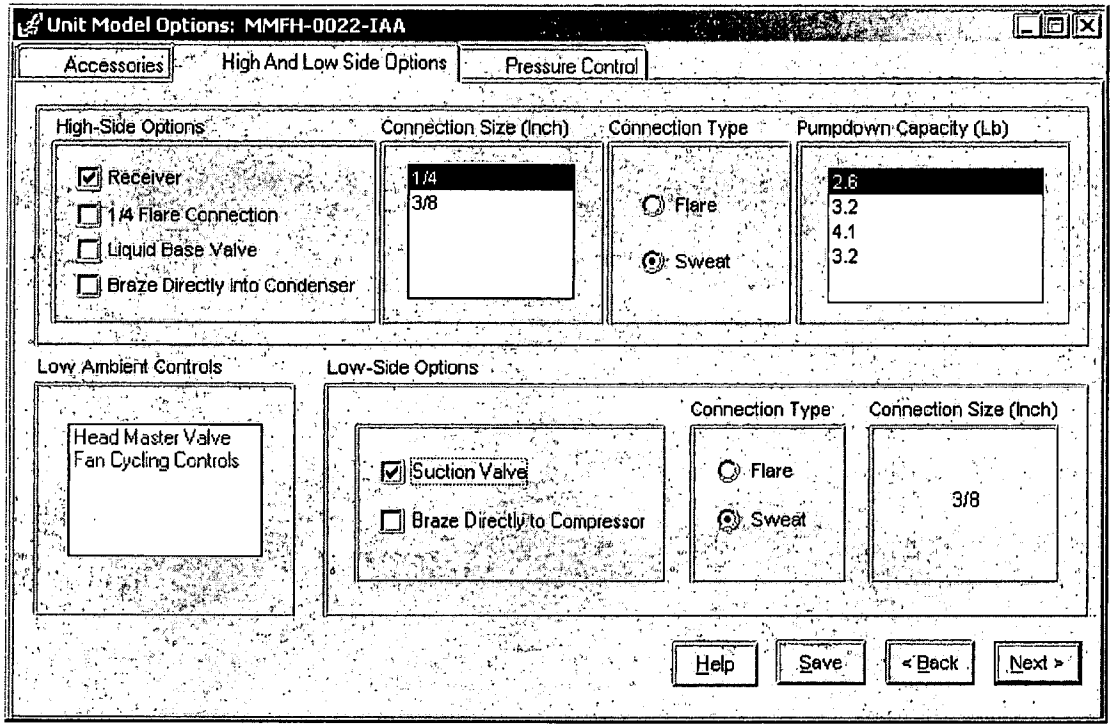
FIG. 14 is a screen-shot illustrating high and low side options of the configurator.

In step 116, the user indicates desired high and low side options (see FIG. 14). The high-side options include a receiver, a flare connection, a liquid base valve (shut-off valve) or a braze directly into condenser. Other options include connection size, connection type (flare or sweat), pumpdown capacity and low ambient (fan cycling, head pressure) controls. The low-side options include a suction valve, braze directly to compressor, connection type (flare or sweat) and connection size.

Figure 15:
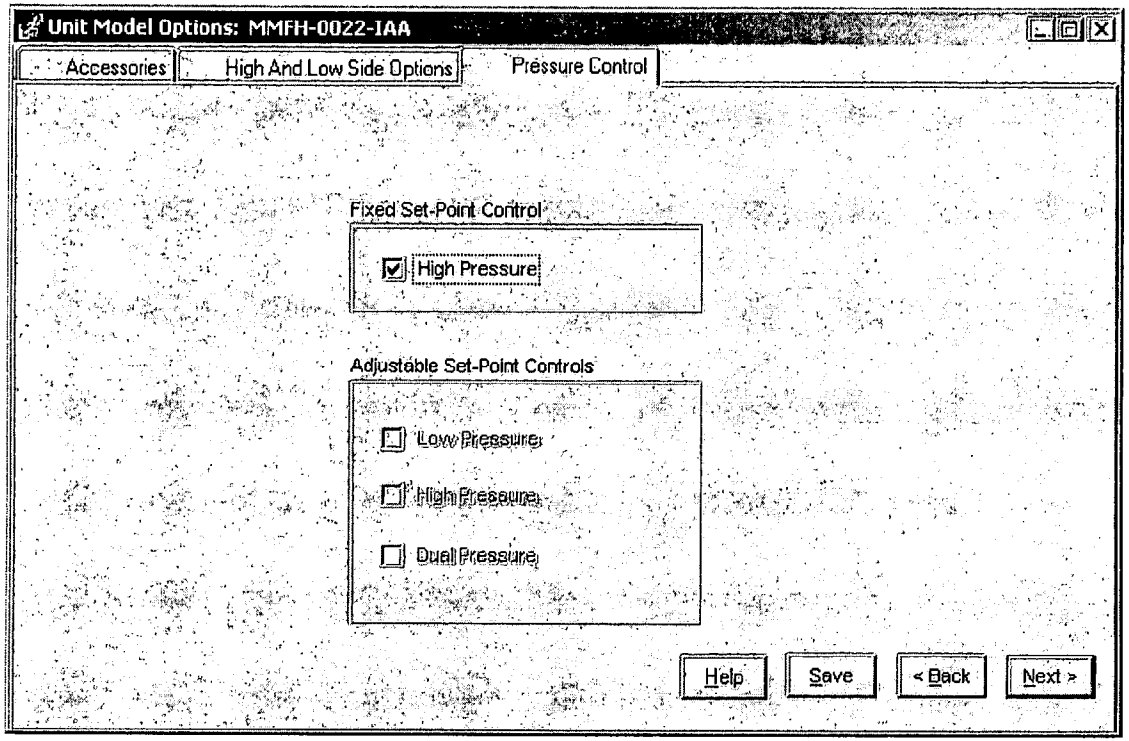
FIG. 15 is a screen-shot illustrating pressure control options of the configurator.

In step 118, the user indicates desired pressure control options (see FIG. 15). The pressure control options include fixed-set point type control and adjustable set-point type control. The fixed set-point type control includes high pressure and the adjustable set-point type controls include low pressure, high pressure and dual pressure. The availability of the pressure control options depend on the particular condensing unit selected. The configurator checks the electrical load handling capability of the pressure control against that of the condensing unit in addition to the maximum pressure requirements of the condensing unit's refrigerant to select the appropriate pressure control part number.

Having selected the desired options in steps 114, 116 and 118 configuration of the condensing unit is complete. The condensing unit configurator of the present invention provides additional business and customer-service information capabilities, such as developing reports (step 120), which will be discussed more fully below.

Figure 16:
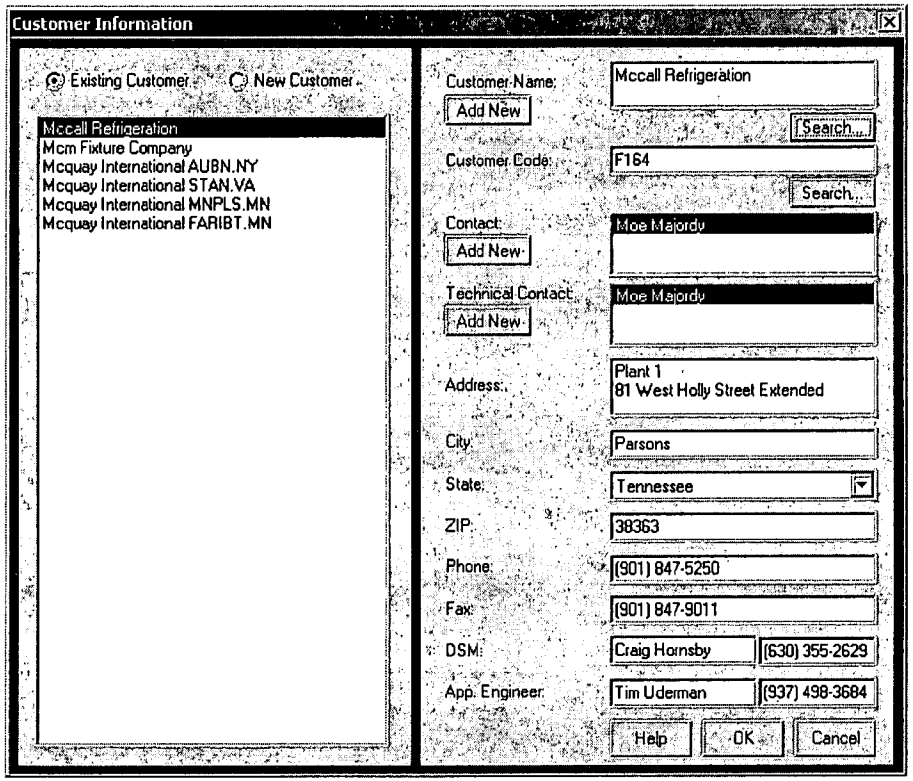
FIG. 16 is a screen-shot illustrating a customer detail screen of the configurator.
Figure 17:
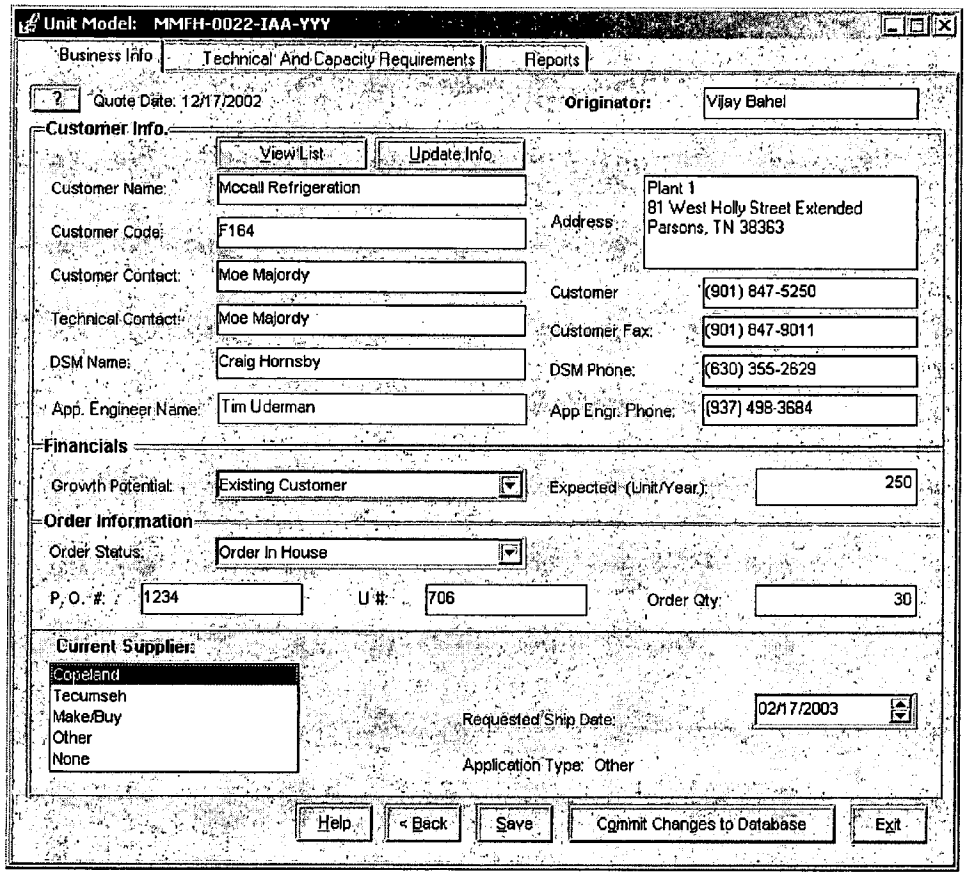
FIG. 17 is a screen-shot illustrating a customer information screen of the configurator.

Referring now to FIG. 16 through 26, the various business and customer-service capabilities will be described in detail. With particular reference to FIG. 16, a user can quickly retrieve or input customer details including name, address, principal contact, shipping address and the like. Customer details are stored in a database that enables searching for an existing customer or adding new customers. The configurator draws data from a central computer system and transforms it into a compatible database on a periodic basis so that data is current. The user selects the customer (by name) and the configurator fills all of the appropriate fields such address, customer contact, application engineer (supporting customer), etc., which automatically reduces the data entry time and human errors. This information is then brought into the next screen shown in FIG. 17. FIG. 17 shows customer details and ordering information. The customer details (address, contact, etc.) are filled in and the order number and quantity, etc., are entered by the user in the appropriate fields.

Figure 18:
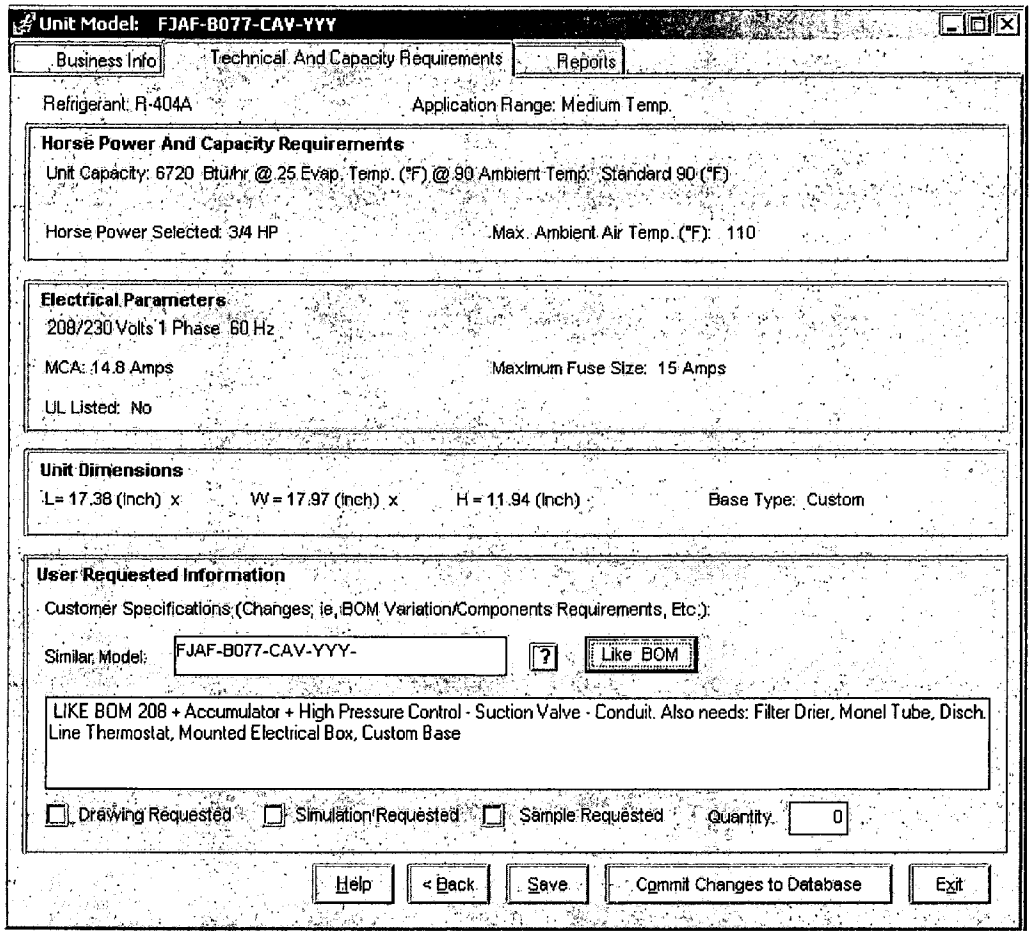
FIG. 18 is a screen-shot illustrating a condensing unit information screen of the configurator.

Referring now to FIG. 18, key information regarding the condensing unit is displayed. The user can enter any special customer requests such as shipment of samples before delivery of actual units. A search of standard off-the-shelf units is also available, which may be close to the configured condensing unit. The configurator provides a graphical comparison of the standard condensing unit and the configured condensing unit. This is accomplished by choosing the Like BOM (Bill-of-Material) button. An example, of the graphical comparison is shown in FIG. 19.

Figure 19:
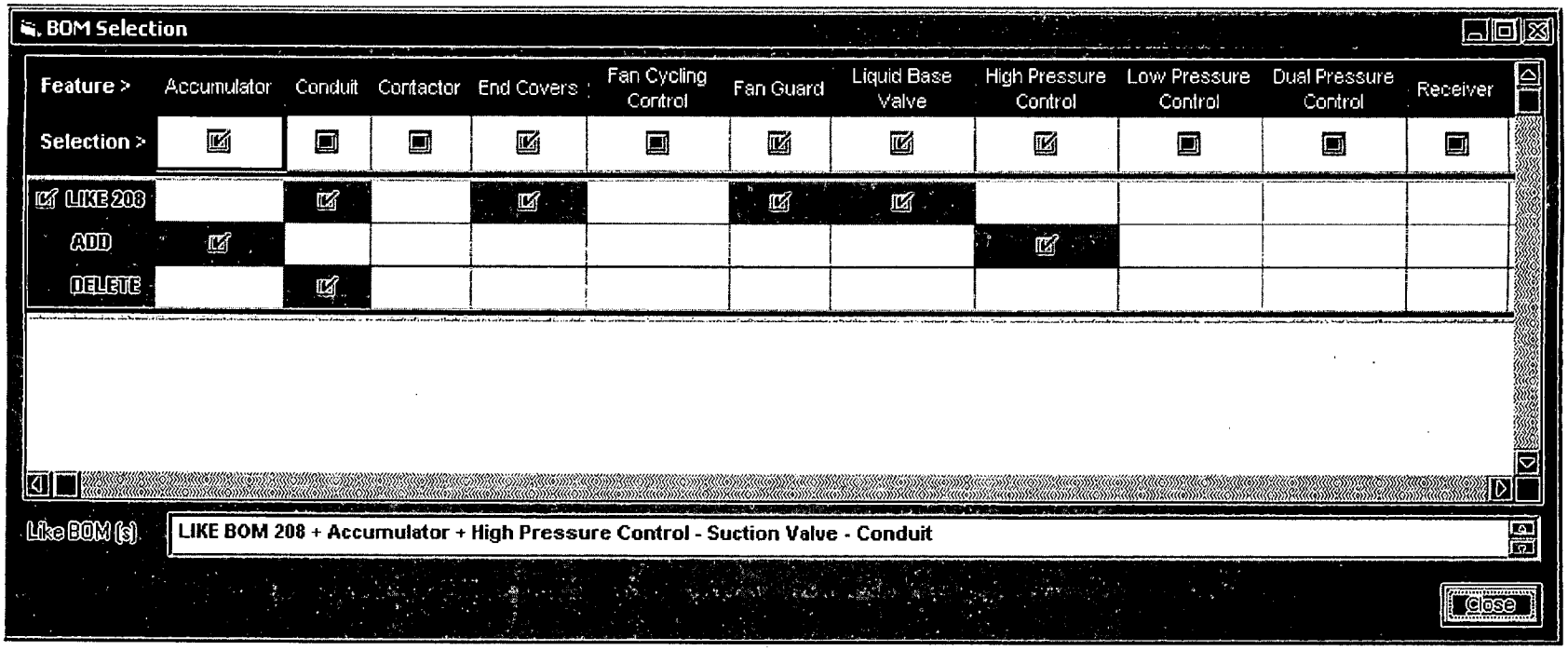
FIG. 19 is a screen-shot illustrating a bill of materials (BOM) selection screen of the configurator.

FIG. 19 illustrates the graphical comparison showing the optional components of the standard off-the-shelf and configured condensing unit. This is provided for informational purposes so that the customer may decide to choose the standard unit with shorter delivery time and possibly with a lower cost instead of the configured condensing unit. The first row labeled 'Selection' shows the optional components of the configured condensing unit. The row entitled 'LIKE 208' shows the optional components of the standard unit having BOM number 208. The next two rows show the components that must be added or deleted relative to the standard BOM. A summary of the added/deleted components is provided in the last row labeled 'LIKE BOM(s)'.

Figure 20:
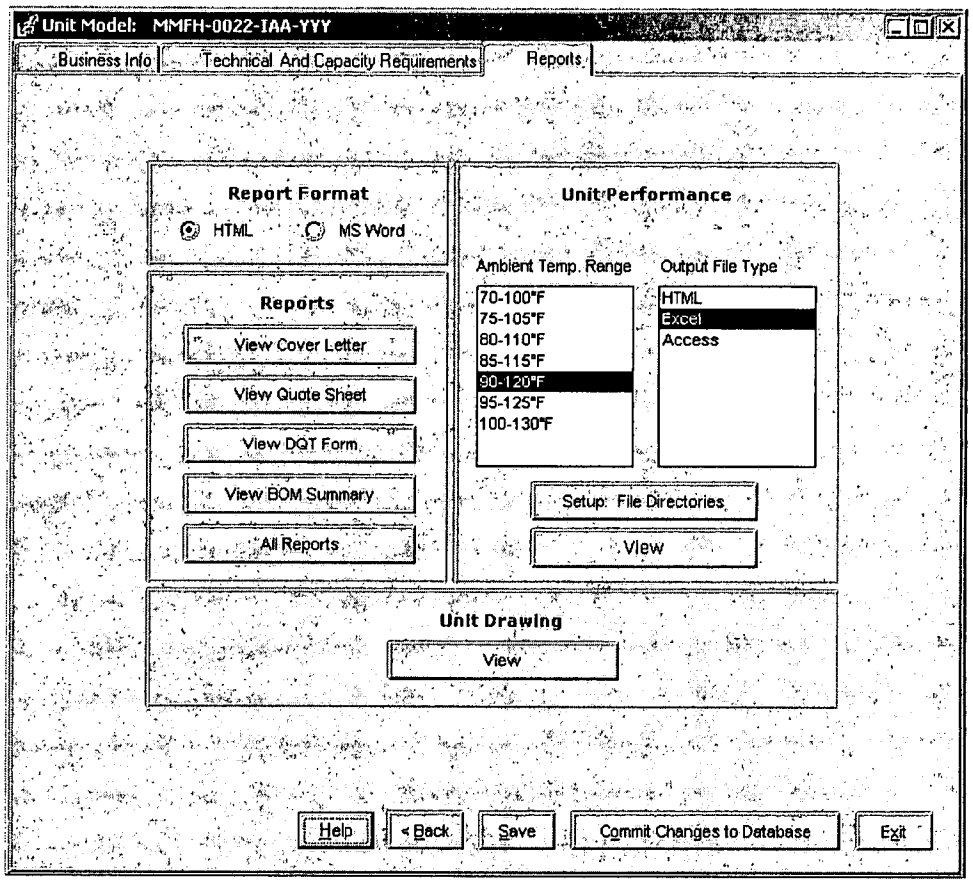
FIG. 20 is a screen-shot illustrating a report option screen of the configurator.
Figure 21:
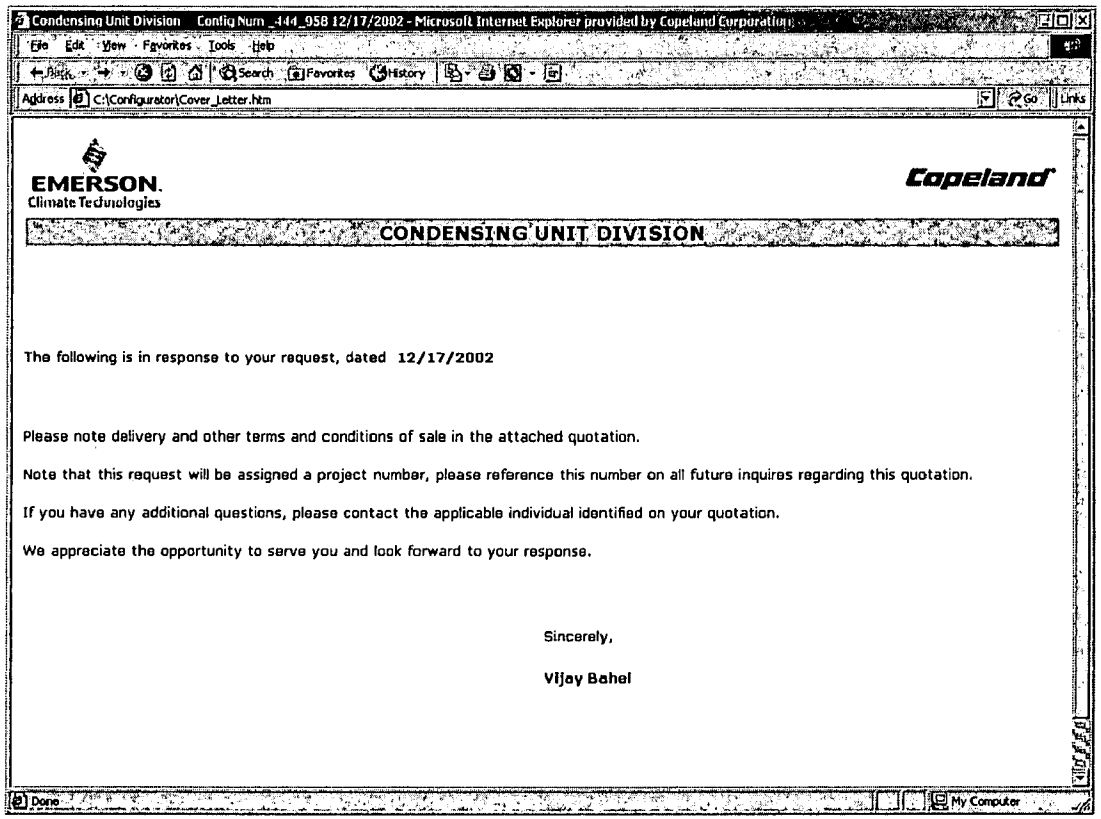
FIG. 21 is a screen-shot illustrating an exemplary cover letter.
Figure 22:
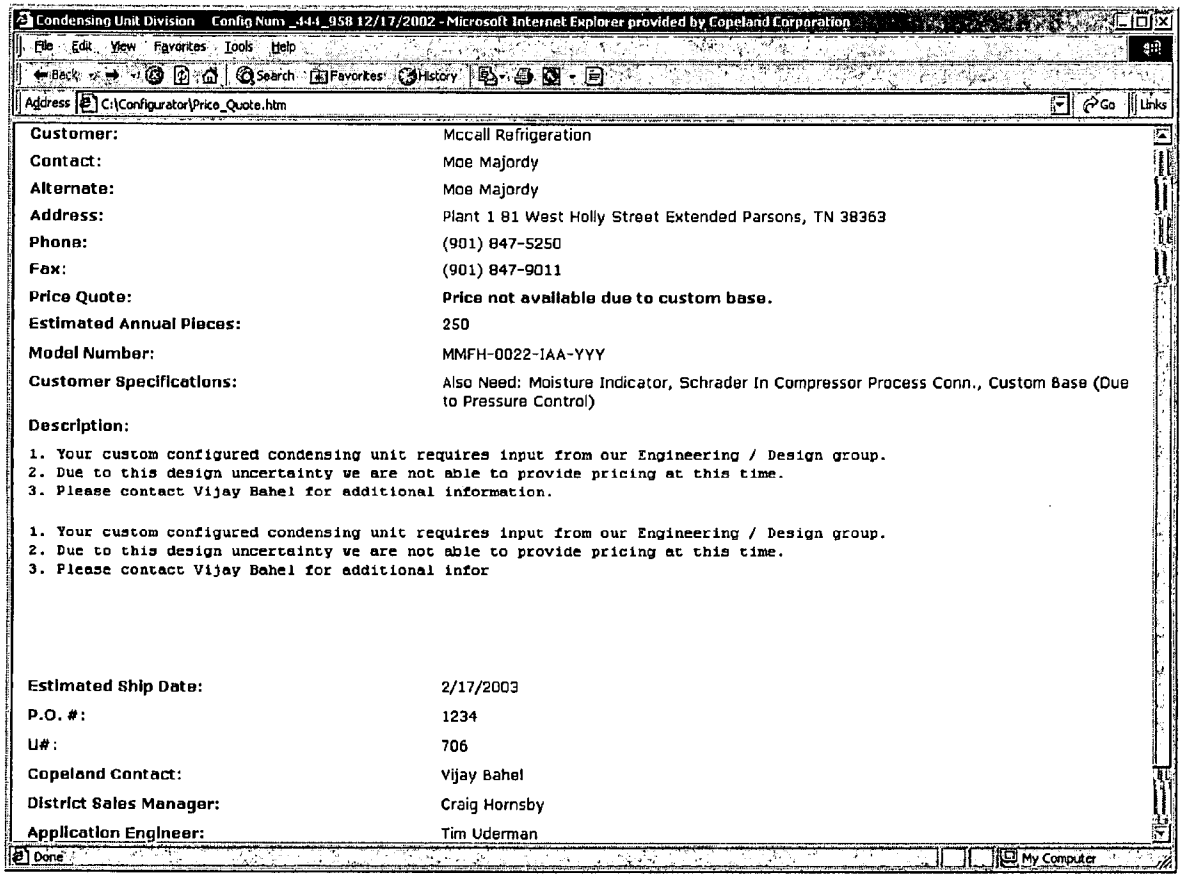
FIG. 22 is a screen-shot illustrating an exemplary quote sheet.
Figure 23:
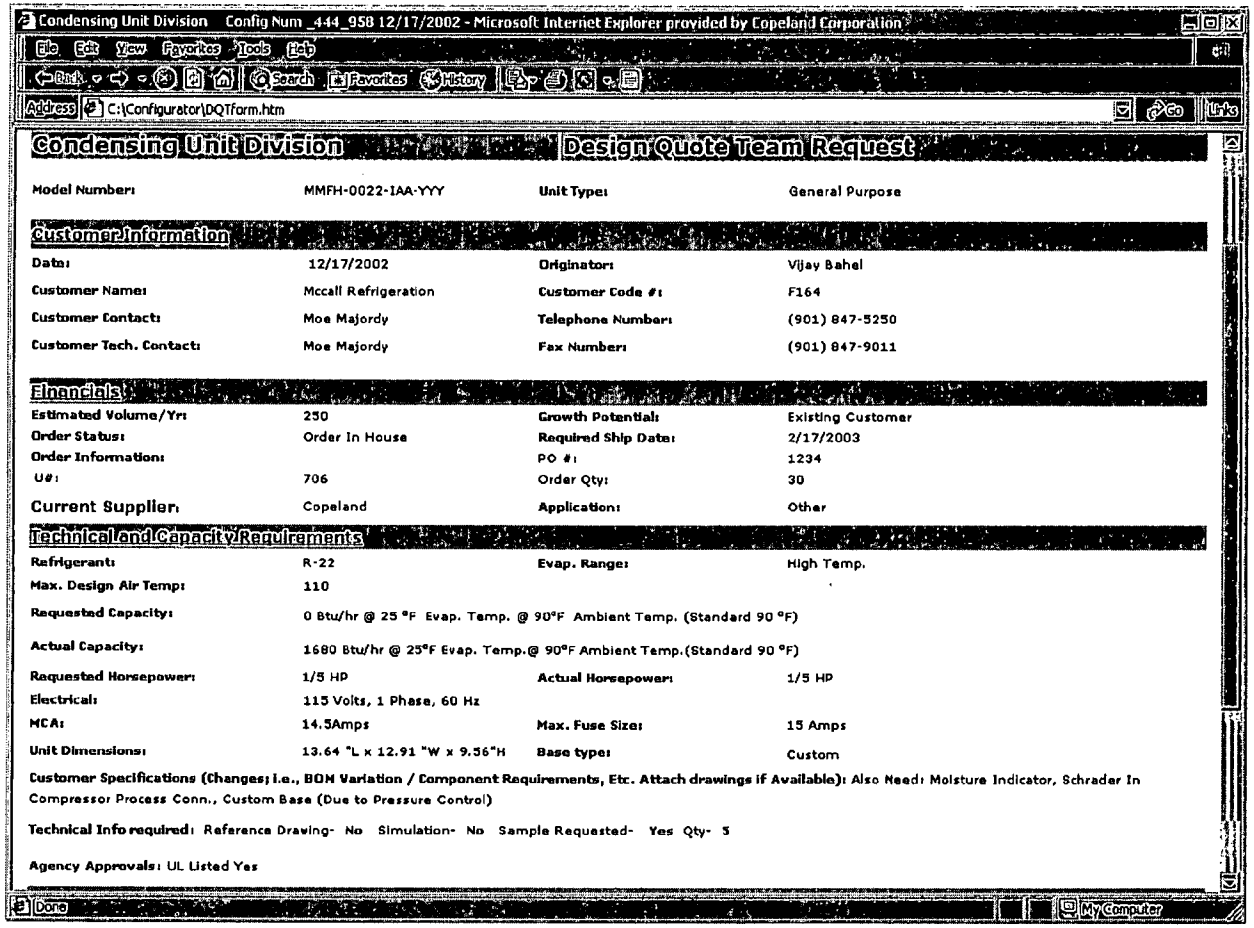
FIG. 23 is a screen-shot illustrating an exemplary design quote team (company specific) sheet.
Figure 25:
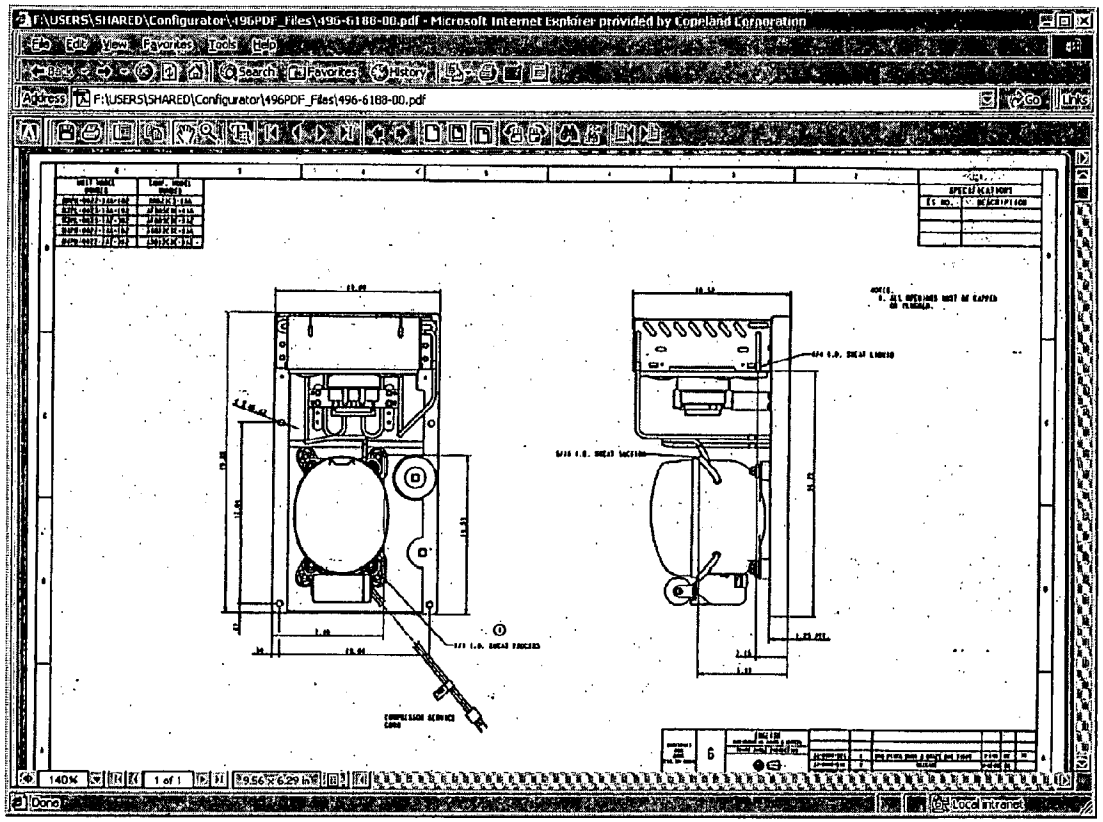
FIG. 25 is a screen-shot illustrating an exemplary reference drawing.

Referring now to FIG. 20, the configurator enables viewing and printing of reports. The report formats include HTML and MS Word. The user can view/print a consolidated report (e.g., Cover Letter (see FIG. 21), Quote Sheet (see FIG. 22), Design Quote Team (DQT) Form (see FIG. 23) and BOM Summary (see FIG. 24)) by choosing the All Reports button. Reports can be viewed/printed individually by choosing the relevant button. The printing function is available when the report is under view.

Thermal performance information is generated by choosing the Unit Performance View button. Thermodynamic algorithms are integrated in the configurator to generate thermal performance based on the configured components of the condensing unit. Default performance data is provided for standard ambient air conditions (e.g., 70-100° F., 75-105° F., 80-110° F., 85-115° F., 90° F.-120° F., 95-125° F. or 100-130° F.) (see FIG. 26). The user may generate performance for other selectable ambient air conditions. Generic drawings showing the layout of the condensing unit are accessed by choosing Unit Drawing|View button (see FIG. 25).

The configurator also enables saving of the condensing unit configuration for future retrieval and editing. This is accessed by choosing the Commit Changes to Database button. This function saves data in a database on a network. The Save button saves data to the local hard drive of the user's computer. The objective of saving to local hard drive is for cases where the configurations are not finalized and have not been submitted to the customer.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method comprising:

receiving an input indicating an operating characteristic for a cooling system;

accessing a condensing unit database storing data representing a plurality of base condensing units and a plurality of standard condensing units, wherein each base condensing unit is initially configured without accessory components and each standard condensing unit is configured with accessory components;

selecting at least one base condensing unit from said condensing unit database based on said operating characteristic;

receiving an input configuring a configured base condensing unit by selecting accessory components for said at least one base condensing unit;

accessing said condensing unit database to select a standard condensing unit based on said configured base condensing unit;

outputting a comparison of said configured base condensing unit with said selected standard condensing unit.

2. The method of claim 1 wherein said selected standard condensing unit is an off-the-shelf condensing unit.

3. The method of claim 1 wherein said receiving said input configuring said configured base condensing unit includes receiving a selection including at least one of an accumulator, a filter drier, a moisture indicator, a schrader fitting, a discharge line thermostat, a crankcase heater, a monel discharge tube, a conduit, a service cord, a base-mounted electrical box, condenser end covers, a fan guard and a defrost timer.

4. The method of claim 1 wherein said receiving said input configuring said configured base condensing unit includes determining high and low side options for said configured base condensing unit.

5. The method of claim 4 wherein said high and low side options include at least one of low ambient controls, pressure vessels, and shut-off valves.

6. The method of claim 1 further comprising determining pressure control options for said configured base condensing unit.

7. The method of claim 1 wherein said operating characteristic includes a cooling system characteristic.

8. The method of claim 7 wherein said cooling system characteristic includes a cooling system capacity.

9. The method of claim 7 wherein said cooling system characteristic includes a cooling system horsepower.

10. The method of claim 7 wherein said cooling system characteristic includes design criteria.

11. The method of claim 10 wherein said design criteria includes at least one of a refrigerant type, a temperature range, an evaporator temperature, a normal air temperature, a maximum air temperature, a frequency, a phase, and a voltage.

12. The method of claim 1 wherein said operating characteristic includes a condensing unit characteristic.

13. The method of claim 12 wherein said condensing unit characteristic includes a condensing unit model number.

14. The method of claim 1 wherein said operating characteristic includes a compressor characteristic.

15. The method of claim 14 wherein said compressor characteristic includes a compressor model number.

16. The method of claim 1 further comprising:

determining a cost of said configured base condensing unit; and outputting a quote sheet including said selected accessory components and said cost.

17. The method of claim 1 further comprising applying safety rules to verify whether said configured base condensing unit meets safety regulations.

18. A system comprising:

a condensing unit database storing data representing a plurality of base condensing units and a plurality of standard condensing units, wherein each base condensing unit is initially configured without accessory components and each standard condensing unit is configured with accessory components;

an accessory database storing data representing accessory components for said plurality of base condensing units;

an interface for accessing said condensing unit database and said accessory database, for receiving input indicating an operating characteristic for a cooling system, for selecting at least one base condensing unit from said condensing unit database based on said operating characteristic, for receiving input configuring a configured base condensing unit by selecting accessory components for said at least one base condensing unit, and for outputting a comparison of said configured base condensing unit with a standard condensing unit selected from said condensing unit database based on said configured base condensing unit.

19. The system of claim 18 wherein said standard condensing unit is an off-the-shelf condensing unit.

20. The system of claim 18 wherein said accessory database includes data representing at least one of an accumulator, a filter drier, a moisture indicator, a schrader, a discharge line thermostat, a crankcase heater, a monel tube, a conduit, a service cord, a base mounted electrical box, condenser end covers, a fan guard and a defrost timer.

21. The system of claim 18 wherein said operating characteristic includes a cooling system characteristic.

22. The system of claim 21 wherein said cooling system characteristic includes a cooling system capacity.

23. The system of claim 21 wherein said cooling system characteristic includes a cooling system horsepower.

24. The system of claim 21 wherein said cooling system characteristic includes design criteria.

25. The system of claim 24 wherein said design criteria includes at least one of a refrigerant type, a temperature range, an evaporator temperature, a normal air temperature, a maximum air temperature, a frequency, a phase, and a voltage.

26. The system of claim 18 wherein said operating characteristic includes a condensing unit characteristic.

27. The system of claim 26 wherein said condensing unit characteristic includes a condensing unit model number.

28. The system of claim 18 wherein said operating characteristic includes a compressor characteristic.

29. The system of claim 28 wherein said compressor characteristic is a compressor model number.

30. The system of claim 18 further comprising a condensing unit cost database, said interface displaying a quote sheet including a cost of said configured base condensing unit.

31. The system of claim 18 further comprising a safety rules database accessible through said interface for verifying whether said configured base condensing unit meets safety regulations.

* * * * *

UNITED STATES PATENT AND TRADEMARK OFFICE

CERTIFICATE OF CORRECTION

PATENT NO. : 7,716,025 B2
APPLICATION NO. : 10/866175
DATED : May 11, 2010
INVENTOR(S) : Vijay Bahel et al.

It is certified that error appears in the above-identified patent and that said Letters Patent is hereby corrected as shown below:

| | |
|---|---|
| Column 2, Line 62 | "stating path" should be --starting path--. |
| Column 6, Line 42 | "FIG." should be --FIGS.--. |
| Column 6, Line 53 | After "such", insert --as--. |

Signed and Sealed this

Nineteenth Day of October, 2010

David J. Kappos

David J. Kappos
*Director of the United States Patent and Trademark Office*